United States Patent [19]

Goslin et al.

[11] 4,061,148

[45] Dec. 6, 1977

[54] PERFORATING APPARATUS FOR ARTICLES

[75] Inventors: John Keith Goslin, Beeston; Thomas Clifford Tomlinson, Tollerton, both of England

[73] Assignee: Imperial Group Limited, London, England

[21] Appl. No.: 727,693

[22] Filed: Sept. 28, 1976

[30] Foreign Application Priority Data

Oct. 11, 1975 United Kingdom ..... 41739/75

[51] Int. Cl.[2] ..... A24C 5/30; B26D 9/00

[52] U.S. Cl. ..... 131/23 R; 131/170 R; 83/2

[58] Field of Search ..... 131/170, 83 R, 252, 131/253, 23; 83/2, 30, 660, 623; 100/94–96

[56] References Cited

U.S. PATENT DOCUMENTS

| | | | |
|---|---|---|---|
| 3,248,977 | 5/1966 | Schneider | 83/2 |
| 3,405,718 | 10/1968 | Grassi | 131/170 R |
| 3,483,873 | 12/1969 | Hinzmann | 131/170 R X |
| 3,737,084 | 6/1973 | Noel | 83/2 |

*Primary Examiner*—Stephen C. Pellegrino
*Attorney, Agent, or Firm*—Larson, Taylor and Hinds

[57] ABSTRACT

A cigar perforator comprises opposing sets of perforating needles which reciprocate at right angles to the cigar to perforate and withdraw from it. The cigar is held during perforation between apertured plates, each aperture having a stripper plate mounted therein which supports the cigar while the perforating needles are withdrawn.

6 Claims, 3 Drawing Figures

PERFORATING APPARATUS FOR ARTICLES

This invention relates to apparatus for perforating articles. The apparatus is primarily designed for perforating cigars or cigarillos but may be used for perforating other articles.

As applied to cigars, one object of the invention is to provide a cigar with at least one pattern of clean perforations in the wrapper and binder through which secondary air is introduced to the smoke stream within the cigar during smoking. By these means the proportion of carbon monoixide in the smoke stream is reduced as compared with the proportion of carbon monoxide in an unperforated but otherwise corresponding cigar.

The invention may be incorporated in a known cigar pressing machine.

According to the invention, there is provided apparatus for perforating an article comprising a perforator and means for holding the article during perforation, wherein there are provided:

a. means for causing the perforator to reciprocate along a path at right angles to the article being held so as to perforate the article and withdraw from it, b. and means for separating the perforated article from the perforator.

Figure 1:
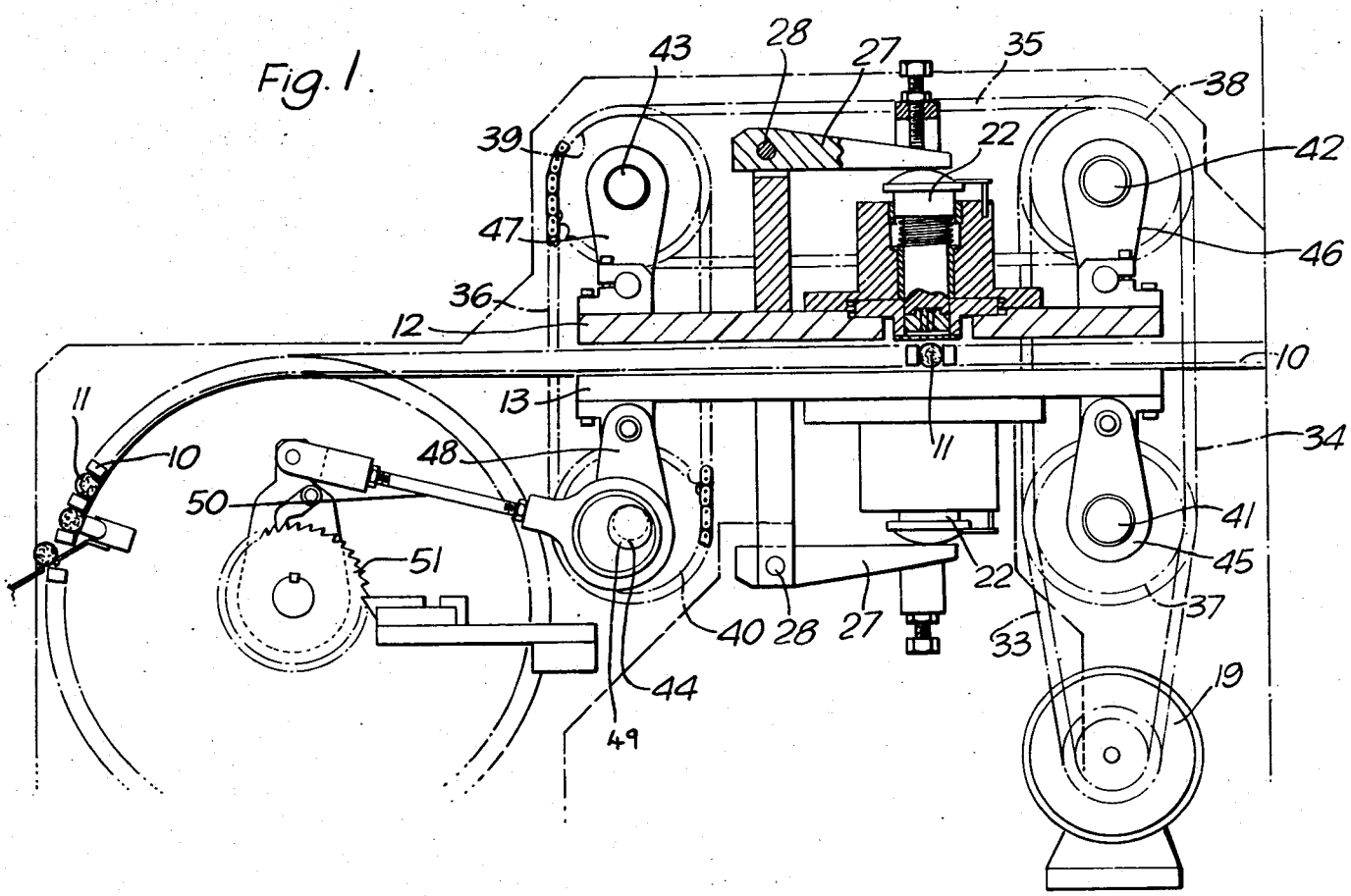
Figure 2:
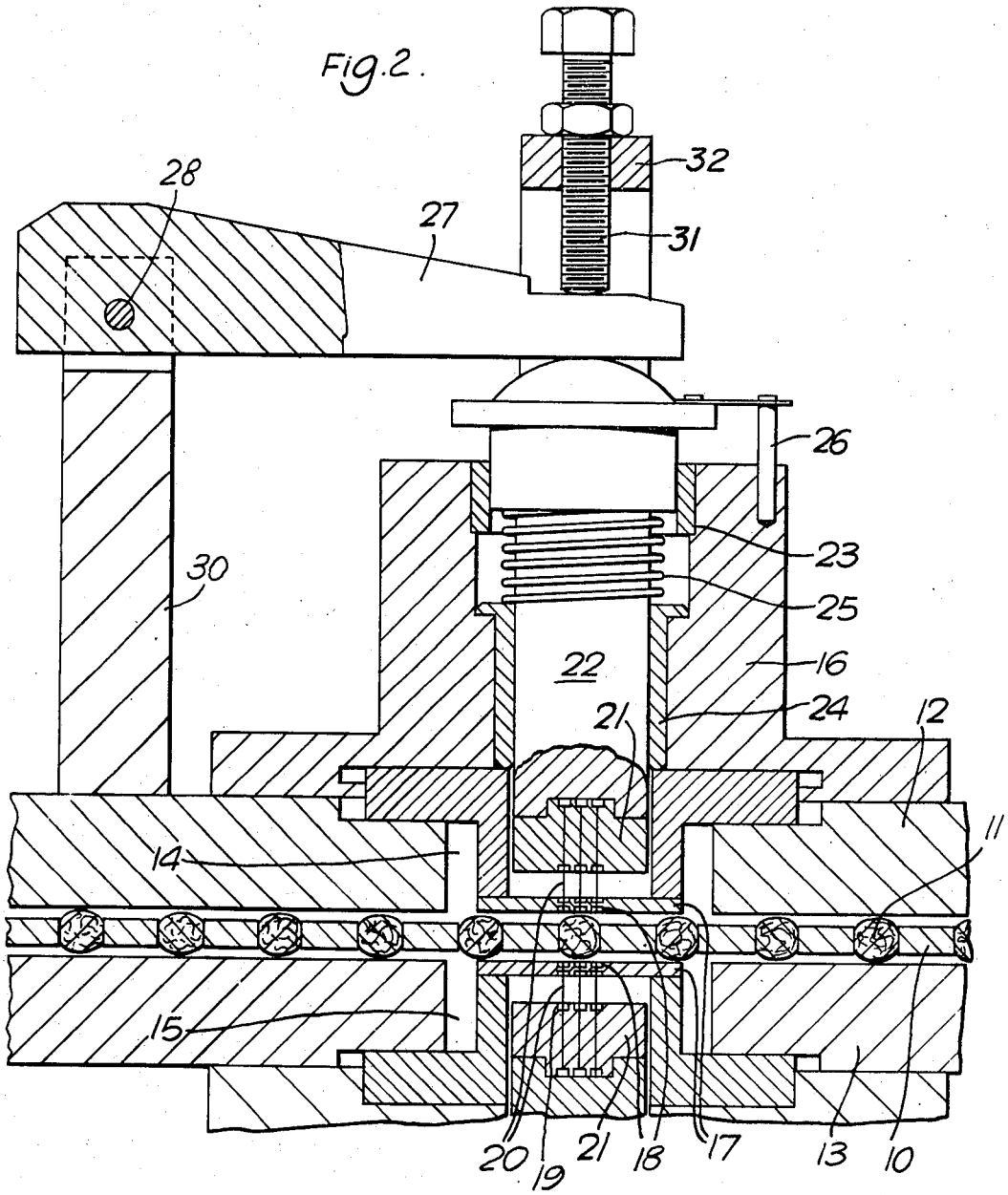
Figure 3:
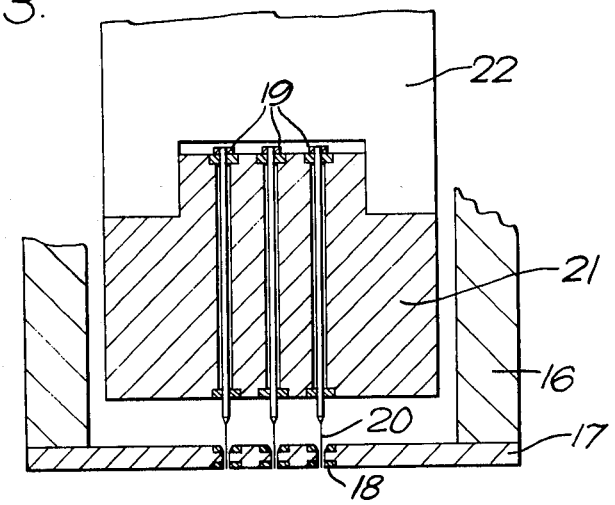

By way of example the invention will now be described with reference to the accompanying drawings of which, FIG. 1 is a diagrammatic side view of an apparatus for perforating a succession of cigars, FIG. 2 is a side view, on an enlarged scale, of a portion of the apparatus, showing a perforator, actuator, and FIG. 3 is a detail view, on an enlarged scale, of a perforator forming part of the apparatus.

A flighted conveyor 10 loaded with cigars 11 passes between moveable horizontal plates or platens 12, 13 provided with opposing apertures 14, 15. The platens 12, 13 which are operated by a motor are linked to the motor to ensure simultaneous movement by a series of chains 33–36 which run on gear wheels 37–40 mounted on transverse driving shafts 41–44. Each shaft is provided with eccentrics arranged to actuate pairs of vertical arms 45–48 the inner ends of which are connected to the platens 12, 13. Driving shaft 44 mounts an eccentric 49, the operation of which controls arm 50 to drive it along a closed path. The arm 50 in turn drives a pawl and ratchet intermittent drive device 51 connected to the shaft of an adjacent sprocket wheel of the conveyor 10. The conveyor 10 moves intermittently to bring successive cigars 11 into and subsequently out of register with the apertures 14, 15, each registration coinciding with a rest period in the conveyor movement. Perforator housings 16 are attached to the non-working surfaces of the platens 12, 13, each housing 16 lying partially within the aperture 14 or 15 and supporting at an inner end a separating or stripper plate 17. The two stripper plates 17 lie flush with the working surface of their respective platens, of which they effectively form a part.

Each stripper plate 17 is formed with perforations which provide parallel guide passages 18 for a set of parallel steel perforator needles 20 projecting from a insert bed 21. Each needle 20 is mounted in a pair of jewelled collars 19 in the bed 21 so that only a fraction of the needle projects from the bed and into a guide passage 18 which is also provided with a jewelled collar. The guide passages act to keep the needles parallel and at right angles to the stripper plate 17.

Each bed 21 together with its needles 20 is removably carried on the leading face of an actuator ram 22 which is mounted for vertical reciprocal movement in upper and lower sleeves 23, 24 set into each housing 16, a pin 26 projecting from the ram 22 and into an adjustable control member 52 guides the ram 22. A return spring 25 located in a recess between the sleeves 23, 24 normally holds the ram 22 in an inoperative or withdrawn position abutting the adjustable control member 52 which is adjusted so that the needles 20 cannot be retracted wholly from their respective guide passages 18 in the stripper plate 17.

A rocker arm 27 contacts the rear face of each ram, each rocker arm being pivotable near one end about a pin 28 supported on a post 30 which is fixed to the non-working surface of the platen 12 or 13. Each rocker arm 27 is rocked by an adjustable tappet 31 mounted on a static carry bar 32, adjustment of the tappet 31 altering the setting of the rocker arm 27 and therefore the displacement by it of the ram 22. Consequently a simple adjustment of the tappet may be used to control the depth of penetration of the cigar by the needles 20. This arrangement allows semi-skilled operatives to control easily the depth of penetration.

In operation, the motor 19 drives the chains 33–36 which rotate the gear wheels 37–40 and their associated driving shafts 41–44. The eccentrics on the driving shafts drive the arms 45–48 up and down to move the parallel platens 12, 13 inwards and outwards in such a manner that the platens 12, 13 approach one another, stop and then retire. The rocker arms 27 mounted on their posts 30 fixed to the platens 12 or 13 move inwards and outwards with the platens. The adjustable tappets 31 mounted on the static carry bars 32 operate the rocker arms 27 during inward movement of the platens 12 or 13, the movement of the rocker arms 27 remote from the pins 28 magnifying this platen motion and urging the rams to move inwards at relatively greater speed to compress the springs 25.

Thus both opposing sets of needles 20 mounted in their respective beds 21 are pushed through their respective guide passages 18 to their perforating positions, at which stage the conveyor 10 is stationary and the platens 12, 13 including the plates 17 are stationary and holding between them the cigars 11. The two sets of needles 20 perforate simultaneously opposing portions of the wrapper and binder of the cigar which lies between the stripper plates 17. The platens and their stripper plates now begin their withdrawal, the rocker arms 27 moving with their respective platens but rocking to give a magnified movement under the influence of the return springs 25 so that the tips of the needles are immediately retracted into the guide passages 18 as the rams commence to move outwards. Any tendency of the perforated cigar to follow one or other of the sets of needles retracting into their guide passages 18 is prevented by one or other of the stripper plates 17 which remain in contact with the cigar until the needles have been retracted, thereby stripping the cigar cleanly off the needles.

The perpendicular movement of the two sets of opposing needles 20 relative to the cigar held at the perforation zone combined with the provision of the stripper plates 17 ensure that the perforation of the cigar is done cleanly, i.e. any tendency for the needles to tear the delicate cigar leaf is avoided or at least minimised. The conveyor 10 ends its rest period, moves the perforated cigar 11 away from the perforating zone and replaces it with the next cigar to be perforated, the movement of the conveyor being controlled by the eccentric-operated arm 50 connected to the drive device 51.

The number and location of the needles in their beds may be varied as desired. For example, there may be 40 needles equally spaced apart in each bed, the arrangement being such that on the cigar the perforations start a short distance from the mouth end.

If desired the needles may be arranged to perforate more than one cigar simultaneously, e.g. each flight of the conveyor may contain a double length cigar which after removal from the apparatus is cut transversely to form two cigars.

In a modification of the invention there is only one perforator, for example one set of needles operating through an aperture in a plate masked by a stripper plate provided with needle guide passages.

What we claim is:

1. Apparatus for perforating a succession of cigars comprising:

first and second opposing parallel plates which define a perforating position therebetween; conveyor means for conveying a succession of cigars to the perforating position; means for interrupting the travel of the cigars during perforation; means for causing the plates to hold each cigar during its perforation and to thereafter to release the perforated cigar, one of the plates including an aperture therein located opposite the perforating position; a stripper plate, extending across the aperture and provided with a guide passage therein, for separating each perforated cigar after perforation; a reciprocating perforator arranged to operate through the guide passage in the stripper plate; and means for causing the perforator to reciprocate along a line at right angles to a cigar in the perforating position so as to penetrate the side of the cigar and then withdraw therefrom with the stroke of the perforator being such that the perforator only partly penetrates the cigar; said stripper plate separating each perforated cigar from the perforator during the withdrawal stroke of the perforator.

2. Apparatus according to claim 1, wherein the perforator is arranged to penetrate only the surface layer of the cigars.

3. Apparatus according to claim 1, wherein the means for causing the perforator to reciprocate comprises a manually adjustable control member the operation of which varies the effective perforating stroke and thus the depth of penetration of the cigars by the perforator.

4. Apparatus according to claim 1, wherein the perforator comprises a plurality of parallel perforating needles projecting from a reciprocating bed and the stripper plate is provided with a plurality of parallel guide passages through which the needles are arranged to reciprocate, which stripper plate also acts to keep the needles parallel to one another and at right angles to the held cigar.

5. Apparatus according to claim 4, wherein the needles are mounted deeply in the bed so that only a fraction of their length projects from the bed.

6. Apparatus according to claim 1, and further comprising:

a further aperture in the other parallel plate opposite the perforating position; a further stripper plate which extends across the further aperture and is provided with a further guide passage; a further reciprocating perforator arranged to operate through the further guide passage; and means for causing the further perforator to reciprocate along a line at right angles to a cigar in the perforating position so as to penetrate the side of the cigar and then withdraw from it; the stroke of the further perforator being such that the further perforator only partly penetrates the cigar; and the further stripper plate separating each perforated cigar from the further perforator during the withdrawal stroke of the latter.

* * * * *